United States Patent [19]

Wieloch

[11] 4,033,768

[45] July 5, 1977

[54] METHOD FOR THE PREPARATION OF AN ELECTROSTATOGRAPHIC PHOTOSENSITIVE DEVICE

[75] Inventor: Francis J. Wieloch, Penfield, N.Y.

[73] Assignee: Xerox Corporation, Stamford, Conn.

[22] Filed: Apr. 14, 1976

[21] Appl. No.: 676,841

[52] U.S. Cl. ..... 96/1.5; 156/137; 427/74; 427/336

[51] Int. Cl.[2] ..... G03G 5/04

[58] Field of Search ..... 96/1.5–1.8, 96/1 PC; 427/74, 76, 336; 156/137

[56] References Cited

UNITED STATES PATENTS

| | | | |
|---|---|---|---|
| 2,615,807 | 10/1952 | Umberger | 96/71 |
| 3,077,398 | 2/1963 | Jones | 96/1.8 |
| 3,697,265 | 10/1972 | Teuscher et al. | 96/1.5 |
| 3,787,207 | 1/1974 | Hasegawa et al. | 96/1 R |
| 3,813,271 | 5/1974 | Riggs | 156/137 |
| 3,819,370 | 6/1974 | Komiya et al. | 96/1.8 |
| 3,928,036 | 12/1975 | Jones | 96/1.5 |

*Primary Examiner*—David Klein
*Assistant Examiner*—Judson R. Hightower
*Attorney, Agent, or Firm*—James J. Ralabate; James P. O'Sullivan; Jerome L. Jeffers

[57] ABSTRACT

Disclosed is a method for the preparation of a seamless belt useful as the photosensitive element in an electrostatographic copying device. The method comprises:

a. applying a film or soluble material over a mandrel;

b. applying a photosensitive layer over the soluble film and heat treating the photosensitive layer;

c. applying a layer of conductive material over the photosensitive layer;

d. applying a seamless, heat shrinkable film of a thermoplastic resin over the layer of conductive material and heat shrinking the film to form a layered, endless belt;

e. removing the layered belt from the mandrel;

f. contacting the belt with a solvent for the soluble film to thereby dissolve the film; and g. turning the belt inside out to provide a belt having layers from the inside out of the seamless polymeric film, the conductive material and the photosensitive layer.

12 Claims, No Drawings

METHOD FOR THE PREPARATION OF AN ELECTROSTATOGRAPHIC PHOTOSENSITIVE DEVICE

BACKGROUND OF THE INVENTION

This invention relates to the art of electrostatographic copying, an electrostatographic photosensitive device and more particularly to a method for the preparation of such a device. The art of electrostatograhic copying, originally disclosed by C. F. Carlson in U.S. Pat. No. 2,297,691, involves as an initial step, the uniform charging of a plate comprised of a conductive substrate normally bearing on its surface a non-conductive barrier layer which is covered by a photoconductive insulating material. This is followed by exposing the plate to activating radiation in imagewise configuration which results in dissipation of the electrostatic charge in the exposed areas while the non-exposed areas retain the charge in a pattern known as the latent image. The latent image is developed by contacting it with an electroscopic marking material commonly referred to as toner. This material is electrostatically attracted to the latent image which is, by definition, in the configuration of those portions of the photoreceptor which were not exposed to the activating radiation. The toner image may be subsequently transferred to paper and fused to it to form a permanent copy. Following this, the latent image is erased by discharging the plate and excess toner cleaned from it to prepare the plate for the next cycle. Typically, the photosensitive plate is in the form of a cylindrical drum generally referred to as the photoreceptor.

The advent of high speed electrostatographic copier/duplicators has lead to the desirability of using endless belts as the photosensitive element. Such belts exhibit the requisite flexibility which enhances their adaptability to high speed copier/duplicators. Suitable belts generally are quite thin and have a surface with a high degree of smoothness due to the need for the production of high quality images on the image retention side of the belt. A further requirement is that the belt have a relatively high tensile strength. Satisfactory belts can be prepared by electroplating a ductile metal, e.g. stainless steel, brass, aluminum or nickel onto a mandrel to form a thin, uniform layer of the metal. Removal of the metal layer from the mandrel provides the substrate upon which the photoconductive material can be deposited to form the xerographic belt. While this electroforming method of preparing the belt substrate has proven quite satisfactory, alternative, less expensive methods would be desirable. One method which has been considered as an alternative involves the use of a thin film of an organic resin as the substrate material. Deposition of a conductive material onto the organic film with the subsequent application of a layer of photoconductive material would provide the necessary multi-layered belt. However, heat treatments are typically necessary to treat the photoconductive material and/or the conductive layer which tend to adversely affect the organic film substrate. This is the case because organic resin films are typically rather heat sensitive and any thermally induced shriveling of the film will disrupt the necessary uniformity of the belt's surface.

It would be desirable and it is an object of the present invention to provide a novel method for the preparation of an endless belt electrostatographic photosensitive device which employs an organic film as the substrate.

A further object is to provide such a method which eliminates the problems associated with the inability of the organic film to withstand the temperatures the belt must be subjected to in treating the photoconductive and/or conductive layer.

SUMMARY OF THE INVENTION

The present invention involves a method for the preparation of a seamless belt useful as the photosensitive element in an electrostatographic copying device. The method comprises:

a. applying a film of soluble material over a mandrel;

b. applying a photosensitive layer over the soluble film and heat treating the photosensitive layer;

c. applying a layer of conductive material over the photosensitive layer;

d. applying a seamless film of a thermoplastic, heat shrinkable resin over the layer of conductive material and heat shrinking the film to form a layered, endless belt;

e. removing the layered belt from the mandrel;

f. contacting the belt with a solvent for the soluble material to thereby dissolve this layer; and g. turning the belt inside out to provide a belt having layers from the inside out of the polymeric film, the conductive material and the photosensitive layer.

DETAILED DESCRIPTION AND PREFERRED EMBODIMENTS

The first step in practicing the present invention is to select a suitable mandrel. Any generally cylindrical body having the necessary integrity to support the layers which form the belt may be employed. The use of a collapsible mandrel, such as the type comprised of three arcuate members as arcs of a cylinder being urged radially outward by means inside the cylinder, is preferred since the collapsed mandrel can be easily removed from the completed belt.

The mandrel is coated to provide a uniform surface with a soluble, preferably water soluble, material. Typically, those water soluble organic materials which form films by evaporation of thin water solutions, such as polyvinyl alcohol, and ethyl hydroxyethyl cellulose, are used. Other water soluble, film forming materials include methylcellulose, starch and polyethylene oxide. Applying an aqueous solution of one of these materials to the outer surface of the mandrel and evaporating the water provides a mandrel with a layer of soluble material on its surface which is ready for the next step of the fabrication procedure.

The layer of photoconductive material will typically comprise some photoconductive substance in combination with an organic resin as either a binder for the photoconductor of overcoating therefore. In one embodiment, a charge generator, such as amorphous selenium, phthalocyanine, a selenium/tellurium alloy or the like is substantially homogeneously dispersed in a solution of an organic charge transport material in a solvent therefore. Typically, the charge transport material is a polymer such as poly (N-vinyl carbazole) or an N-substituted polymeric acrylic acid amide of pyrene although non-polymeric transport materials such as tetraphene or 1-bromopyrene may also be used. Dispersing the charge generator in the transport material solution and applying the resulting photoconductive complex to the layer of soluble material on the mandrel provides the layer of photoconductive material upon evaporation of the solvent. The thermal evaporation of the solvent is not problematical since the organic resin film substrate has not yet been applied. In addition, any thermal treatment necessary to crosslink the active transport polymer may be carried out at this point. Had the belt been fabricated from the bottom up rather than vice versa as in the instant process, this thermal treatment could be troublesome since even a very small disruption in the surface of film caused by heat will have a negative impact on the acceptability of the finished belt.

As an alternative to the device employing a charge generator uniformly dispersed in the charge transport material, a layered configuration can be employed. In such a configuration, the charge transport material is solvent coated onto the layer of soluble material and the solvent evaporated whereupon the charge generator is applied to the charge transport material such as by vapor deposition. In this embodiment, the photosensitive layer actually consists of two sublayers, i.e., the charge generator and charge transport layers. Amorphous selenium may be employed as the charge generator. In this configuration, it is possible to thermally convert the amorphous selenium charge generator to the crystalline trigonal form by the use of carefully controlled process parameters. These process parameters involve the deposition of a very thin (0.03 to 0.8 micron) layer of amorphous selenium onto the transport layer and subsequent conversion of the amorphous selenium to its trigonal form by heating it at a temperature of from 125° to 210° C for a period of 1 to 24 hours as disclosed in copending application Ser. No. 473,858, now U.S. Pat. No. 3,961,953. Preferably, in this embodiment, the layer of conductive material is applied to the selenium layer before its thermal conversion to the trigonal form in order to prevent vaporization of the selenium during the heating step. The rigorous heating required in this embodiment would be particularly detrimental to the organic film support and it can be readily seen that the fabrication method of the present invention is a useful improvement.

Furthermore, it is often desirable to heat the layer of transport material when a polymer is used above its glass transition temperature before application of the charge generator to thereby remove internal strains in the layer and prevent cracking of the finished product. This thermal treatment, which is more fully disclosed in copending application Ser. No. 592,839, further emphasizes the desirability of fabricating the photoconductive layer before application of the organic film.

In yet another embodiment, the photoconductive layer consists of two sublayers one of which is an insulating organic resin. Application of the insulating resin to the soluble material with subsequent application of a layer of photoconductive pigment, usually dispersed in an resinous binder, provides a photoconductive layer useful in the induction imaging process disclosed by Hall in U.S. Pat. No. 3,234,019.

The next step in the process is to form a layer of conductive material over the photoconducting layer. The conductive layer is typically in the form of a thin metal film. The maximum thickness of the conductive layer is dictated solely by the requirement that the finished belt be flexible. Typically, the metal layer is applied to the exposed surface of the photoconductive layer by vacuum deposition techniques such as ion plating or R.F. sputtering. Among those materials which may be used to fabricate the conductive layer are brass, steel, or a conductively coated dielectric or insulator. Aluminum is generally preferred.

When the conductive layer has a blocking layer on its surface on the photoconductor side of the layer, as would be the case where a small amount of the vapor deposited aluminum oxidized to $Al_2O_3$, or where its surface is naturally blocking, as in the situation where substantial amounts of energy are required to promote charge carriers from the conductive to the photoconductive layer, no separate blocking layer is needed. In other situations, a separate blocking layer will be required to prevent dark charge injection from the conductive layer to the photoconductive layer. Where a separate blocking layer is required, a thin (about 30 A to 1.0 micron) layer of a material such as nylon, an epoxy, or an insulating resin such as polystyrene or a cellulose base resin may be applied to the photoconductive layer before deposition of the conductive layer.

The next step in fabricating the endless belt by the process of the present invention involves the application of the organic film overcoating which will be the substrate when the belt is turned inside out in the final step. A film, as defined by *Modern Plastics Encyclopedia*, is a flat section of a thermoplastic resin or a regenerated cellulosic material which is very thin in relation to its length and breadth, and which has a nominal thickness not greater than 10 mils. The heat shrinkable films useful in the present invention gain their heat shrinkability from an elastic "memory" imparted to certain thermoplastic films during their manufacture by either stretch-orientation or by crosslinking induced through electron irradiation. Shrinkage, because of this plastic memory, takes place when heat is applied to the film and it tends to revert to its original unoriented state. The principal heat shrinkable films are polyesters, polyethylenes, polypropylenes, polystyrenes, polyvinyl chlorides, polyvinylidene chloride copolymers and rubber hydrochloride.

The prime physical property necessary in the films used in the present invention is that of high tensile strength. In this regard, oriented polypropylene must be considered a preferred shrink film due to its high tensile strength and good shrinkability.

Application of the thermoplastic film to the exposed surface of the conductive layer is most conveniently accomplished by fitting a seamless sleeve of the film material over the mandrel having the layers of soluble material, photoconductive material and conductive material on its surface. Once the sleeve, which may be fabricated by blown-bubble extrusion processes, is placed over the madrel, it is shrunk by the application of mild heat to thereby form a tight bond with the next adjacent layer. Optionally, a layer of adhesive can be provided between the film and conductive layer to ensure the integrity of the bond therebetween.

The layered belt, prepared as described above, is removed from the mandrel and the layer of soluble material contacted with an appropriate solvent therefore to remove it and expose the photoconductive layer. Those water soluble materials previously referred to are generally preferred for the sake of convenience, however, materials soluble in solvents other than water can be used where desired.

At this point, the last step in the fabrication method, i.e., that of turning the belt inside out to provide a device comprising, from the inside out, an organic film, a conductive layer and a photoconductive layer is carried out. The finished belt can be mounted on a tri-roller setup and rotated in the normal manner of operation.

The invention is further illustrated by the following example.

EXAMPLE

A 36 inch diameter mandrel is provided which consists of a resilient tubular member of rubber coated with a polysiloxane resin having centrally dispersed therein three rigid arcuate sections which are radially urged against the resilient tubular member by rigid pedals which are circularly spaced around and pivotally connected to a threaded shaft. The shaft is connected to a threaded bolt for moving it relative to the rigid arcuate members thereby urging the pedals against the arcuate members to hold them firmly against the tubular member and provide a rigid mandrel.

An aqueous solution of polyvinyl alcohol is applied to the surface of the resilient tubular member and the water evaporated to leave a uniform film of polyvinyl alcohol on the surface of the tubular member.

A photosensitive binder layer containing unoriented photoconductive particles of the X-form of metal free phthalocyanine dispersed in poly(vinylcarbazole) in a weight ratio of 48:1 poly(vinylcarbazole) to the photoconductive particles is prepared by the following technique: Thirty one grams of a 16.7 weight percent poly(-vinylcarbazole) solution is formed by dissolving the appropriate amount of BASF Luvican M170 grade poly(vinylcarbazole) in 180 grams of toluene and 20 grams of cyclohexanone. To this solution is added 0.25 grams of the X-form of metal free phthalocyanine and 10 grams of toluene. The mixture is milled with steel milling shot for about 30 minutes to form a well dispersed suspension.

The suspension is uniformly applied to the exposed surface of the layer of soluble material on the mandrel and air dried at 110° C for several hours to provide a uniform photosensitive coating about 24 microns in thickness. In order to provide a barrier against dark charge injection, a 0.2 micron expoxy layer is applied over the photosensitive layer by conventional solvent coating techniques.

After curing of the epoxy layer, aluminum is vacuum deposited uniformly to provide an aluminum layer approximately 0.05 micron thick adjacent to the epoxy layer.

At this point, a tubular sleeve of oriented polypropylene shrink film having an inside diameter several mils greater than the diameter of the previously deposited aluminum layer is slipped over the mandrel bearing the photosensitive and aluminum layers. At this point, the polypropylene sleeve is gently heated to shrink it thereby providing a tight fit between it and the surface of the aluminum layer.

Releasing the pressure urging the rigid arcuate members against the tubular resilient member of the mandrel permits one to remove the mandrel from the belt fabricated on its surface. The polysiloxane film on the resilient tubular member of the mandrel enhances release of the belt from this member.

The polyvinyl alcohol film adjacent to the photosensitive layer is dissolved with water and the belt turned inside out. The belt is trimmed to the desired width, and at this point is ready for use as the photosensitive element in an electrostatographic copying machine.

What is claimed is:

1. A method for the preparation of a seamless belt useful as the photosensitive element in an electrostatographic copying device which comprises:
   a. applying a film of soluble material over a mandrel;
   b. applying a photoconductive layer over the soluble film and heat treating the photoconductive layer;
   c. applying a layer of conductive material over the photosensitive layer;
   d. applying a seamless shrink film of a thermoplastic resin over the layer of conductive material to form a layered, endless belt;
   e. removing the layered belt from the mandrel;
   f. contacting the belt with a solvent for the soluble film to thereby dissolve the film; and
   g. turning the belt inside out to provide a belt having layers from the bottom up of the polymeric film, the conductive material and the photoconductive layer.

2. The method of claim 1 wherein a layer of adhesive is applied to the exposed surface of the conductive material to bind the polymeric film thereto.

3. The method of claim 1 wherein the mandrel is collapsible.

4. The method of claim 1 wherein the soluble material is polyvinyl alcohol, ethyl hydroxyethyl cellulose, methylcellulose, starch or polyethylene oxide.

5. The method of claim 1 wherein the photoconductive layer comprises a charge generator material dispersed in an organic charge transport material.

6. The method of claim 5 wherein the charge generator material is the X form of metal free phthalocyanine and the charge transport material is poly (N-vinylcarbazole).

7. The method of claim 1 wherein the photoconductive layer comprises a layer of a charge generating material and a separate layer of a charge transport material.

8. The method of claim 1 wherein the photoconductive layer comprises a layer of photoconductive pigment and a separate layer of an electrically insulating resin.

9. The method of claim 1 wherein the conductive material is brass, steel or a conductively coated dielectric or insulator.

10. The method of claim 1 wherein a 30 A to 1.0 micron thick blocking layer is applied to the exposed surface of the photoconductive layer before the conductive layer is applied.

11. The method of claim 1 wherein the polymeric shrink film is a polyester, a polyethylene, a polypropylene, a polystyrene, a polyvinyl chloride, a polyvinylidene chloride copolymer or rubber hydrochloride.

12. The method of claim 1 wherein the shrink film is oriented polypropylene.

* * * * *